US005791480A

United States Patent [19]

Fall

[11] Patent Number: 5,791,480

[45] Date of Patent: Aug. 11, 1998

[54] ENCASED CONTAINER FOR STORING SPECIMENS

[76] Inventor: Richard P. Fall, 17803 La Salle Ave., Gardena, Calif. 90248

[21] Appl. No.: 704,151

[22] Filed: Aug. 28, 1996

Related U.S. Application Data

[60] Provisional application No. 60/003,053, Aug. 31, 1995.

[51] Int. Cl.[6] ..... B65B 85/00

[52] U.S. Cl. ..... 206/569; 206/776

[58] Field of Search ..... 206/569, 775, 206/776, 777, 778; 220/403

[56] References Cited

U.S. PATENT DOCUMENTS

| | | | |
|---|---|---|---|
| 1,428,430 | 9/1922 | Gerojohn . | |
| 1,852,035 | 4/1932 | Von Frankenberg . | |
| 1,910,236 | 5/1933 | Butler | 206/569 X |
| 1,986,057 | 1/1935 | Hackworth . | |
| 2,028,030 | 1/1936 | Walker . | |
| 2,075,987 | 4/1937 | Houck . | |
| 2,206,848 | 7/1940 | McAvoy . | |
| 3,487,921 | 1/1970 | Barth et al. | 206/776 X |
| 3,615,006 | 10/1971 | Freed . | |
| 4,208,826 | 6/1980 | Lindaman . | |

*Primary Examiner*—Jacob K. Ackun
*Attorney, Agent, or Firm*—Edward A. Sokolski

[57] ABSTRACT

A container for use in storing specimens such as dried insects, pressed plants, documents, fabric, art work, and other archival material is sealed off from the ambient atmosphere by placing sealing cement between the sides, top and bottom of the container. In this manner the specimens are kept in an environment which is protected from ambient factors such as air and other gasses, dust, humidity, ultraviolet, and other factors including the common acid degassing of wood construction storage systems which would tend to deteriorate such specimens. A window is provided to enable viewing of the specimens in the container, this window being fabricated of an ultraviolet blocking material. While the interior of the container is effectively sealed around the window, a simple latching (and unlatching) device is provided for retaining the window in position such that the window can be readily lifted off the container in replacing specimens or installing new specimens in the container.

10 Claims, 2 Drawing Sheets

ENCASED CONTAINER FOR STORING SPECIMENS

This application claim the benefit under U.S.C. §119(e) of any U.S. Provisional Ser. No. 60/003053 filed Aug. 31, 1995.

BACKGROUND OF THE INVENTION

1. Field of the Invention

This invention relates to a container for storing specimens and more particularly to such a container which is sealed off from the ambient atmosphere.

2. Description of the Related Art

Air tight and water tight cases and containers are described in the prior art for various uses such as storing cosmetics and other personal articles as well as specimens. Typical such devices are described in Pat. No. 1,986,067 issued Jan. 1, 1935 to Hackworth and Pat. No. 2,075,987 issued Apr. 6, 1937 to Houck. Such devices, while adequate for the intended purpose, do not have adequate structure for reliably protecting valuable specimens from the ambient atmosphere and at the same time enabling ready access to the case for replacing or installing new specimens. Where valuable specimens are involved, protection must be afforded against ambient factors such as air and other gasses, dust, humidity, ultraviolet and other factors including the common acid degassing of wood construction storage systems which would tend to deteriorate such specimens. Prior art devices are generally not designed to adequately afford such protection while at the same time allowing ready access to the interior of the case or container.

SUMMARY OF THE INVENTION

The device of the invention is an encased container the interior of which is effectively sealed off from the ambient atmosphere. This end result is achieved by using a side wall construction employing an outer wall portion and an inner wall portion with an air space therebetween. The side wall is formed from four similar wall sections constructed of a metal such as aluminum which are riveted or screwed and cemented together to form a rectangle. A firm attachment is assured by a pair of spaced apart rod members which are supported on the outer wall portion and run around the entire length of the side wall. These rod members are riveted to the outer wall portion of the side wall. The bottom of the container is sealed to the sides by means of cement. The top of the container, which forms a window, is transparent and is of an ultraviolet blocking material. The top of the container is retained in sealed relationship with the top of the side wall by means of latches which force the top against a flexible tubing seal installed in a channel which runs completely around the wall, thereby forming a sealing gasket. The top window of the container can readily be removed by releasing the latches.

It is therefore an object of this invention to provide an improved specimen container which is sealed against the ambient atmosphere.

It is a further object of this invention to provide a sealed specimen draw having a transparent window which can readily be removed and reinstalled.

Other objects of the invention will become apparent in view of the following description taken in connection with the accompanying drawings.

DETAILED DESCRIPTION OF THE INVENTION

Referring now to FIGS. 1–6, an embodiment of the invention is shown. The container has an outside wall 11 which can be fabricated of a suitable metal such as aluminum. Wall 11 has a hollow configuration being formed by an outer wall portion 11*a* which surrounds inner wall portion 11*b* with a space 11*c* there between.

Figure 2:
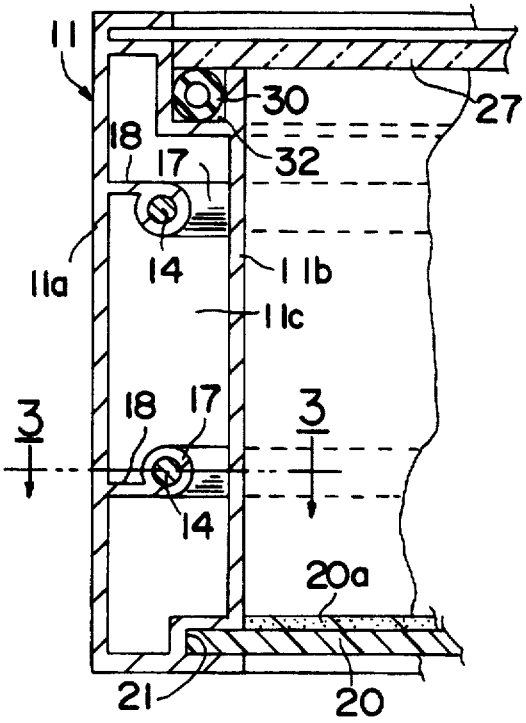
FIG. 2 is a cross sectional view taken along the plane indicated by 2—2 in FIG. 1.
Figure 4:
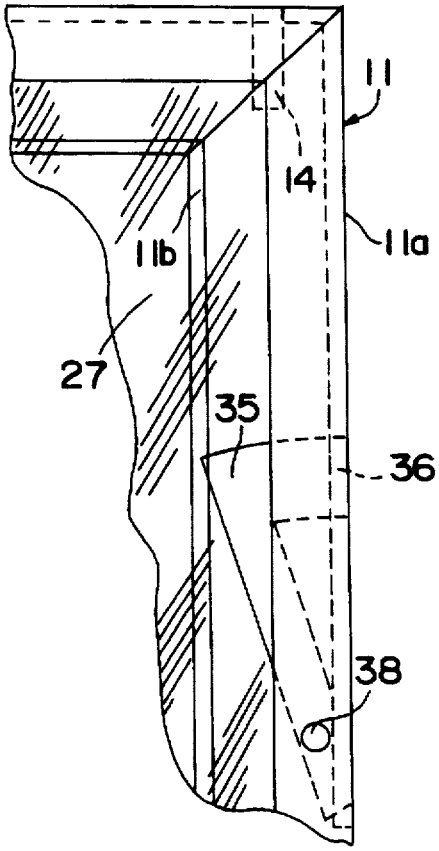
FIG. 4 is a top plan cutaway section illustrating the latching mechanism of the preferred embodiment.
Figure 3:
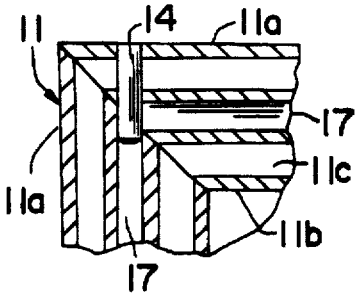
FIG. 3 is a cutaway sectional view showing the wall structure of the preferred embodiment.
Figure 5:
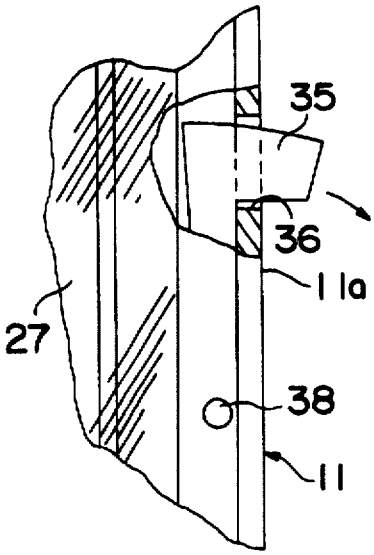
FIG. 5 is a top plan cutaway section illustrating the operation of the latching mechanism.

The wall 11 is fabricated of four pieces which are riveted or screwed together at their corners by means of rivets or screws 14, as best can be seen in FIGS. 2 and 3. The four wall pieces can also be joined together by means of aluminum right angle pieces installed along the inner surfaces of inner wall portions 11*b* and riveted to the inner wall portions. A firm attachment is achieved by employing a pair of spaced apart C-shaped rod members 17 which are supported on outer wall 11*a* by means of ledges 18 and run around the entire length of such wall. Rivets 14 are force fitted into C-shaped rod members 17 to join the wall sections together. Cement is placed between the wall sections when they are joined together to assure an air tight seal.

The bottom 20 of the container is fabricated of an opaque acrylic. The bottom may also be fabricated of aluminum or a clear acrylic. The bottom is installed in slot 21 which runs around the bottom of the tray walls. Bottom 20 is sealed to the sides of the slot by means of an injected silicone cement. A resilient sheet 20*a* is attached to the bottom by cementing, this sheet providing a base to which specimens may readily be pinned. Sheet 20*a* may be fabricated of a crosslinked polyethylene foam and is attached to bottom 20 with a polyamide hot melt adhesive.

Figures 1, 6:
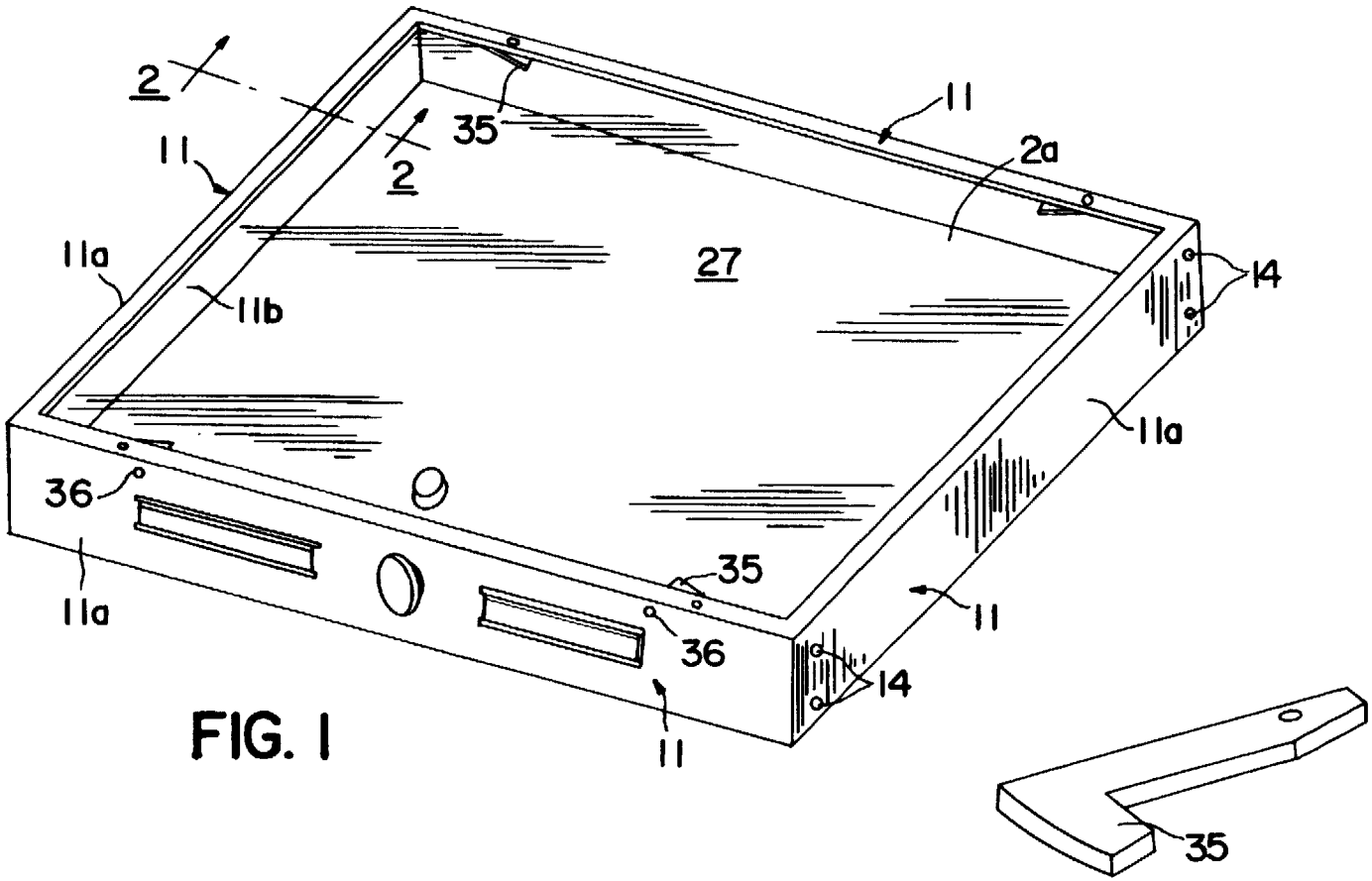
FIG. 1 is a top front perspective view of a preferred embodiment of the invention.
FIG. 6 is a top perspective view illustrating the latch of the preferred embodiment.

The top 27 of the container is fabricated of a transparent ultraviolet blocking acrylic material and forms a window for the container. Flexible tubing 30 is installed in channel 32 formed in the top of side wall 11 and runs completely there around. Tubing 30 may be fabricated of 40 durometer tubular silicone. Top window 27 is retained in sealed relationship with the top of the container wall by means of latches 35. These latches are installed in slots 36 formed in the walls for pivotal motion on pins 38. The latches, as can be seen in FIG. 6, abut against the top surface of window 27 and force the window down against tubing 30 which thus forms a gasket to seal the window to the walls. Latches 35 can readily be manually moved from the retaining position shown in FIG. 4 to the releasing position shown in FIG. 5 to permit removal of the window 27.

If an oxygen free environment is needed within the container to avoid oxidation of the specimens being stored, access and venting plugs can readily be installed in the container and the air removed and replaced with nitrogen or another inert gas or may be removed by means of an oxygen scavenger.

While the invention has been described and illustrated in detail, it is to be clearly understood that this is intended by way of illustration and example only and not by way of limitation, the scope of the invention being limited only by the terms of the following claims:

I claim:

1. A container for encasing specimens sealed from the ambient atmosphere comprising:

a side wall forming a perimeter, flexible tubing forming a gasket mounted on the top of said side wall and running completely therearound, a bottom portion comprising a substantially flat plate member, means for attaching said bottom portion to the bottom of said side wall in sealed air tight relationship therewith, a top portion forming a window comprising a substantially flat transparent plate member, and a pair of latch members pivotally mounted on opposite sides of said side wall, said latch members being manually actuable between a first pivotal position whereat said latch members drive said top portion against said gasket to form an air tight seal between the top portion and the side wall with said top portion retained to said side wall, and a second pivotal position whereat said top portion is released from said side wall.

2. The container of claim 1 wherein said side wall has an inner wall portion and an outer wall portion separated from the inner wall portion by a space.

3. The container of claim 2 and further including a pair of spaced apart rod members attached to and running completely around the inner surface of the outer wall portion.

4. The container of claim 1 wherein said side wall is rectangular and is formed from four side wall sections and means for joining said sections together.

5. The container of claim 4 wherein each said side section has an inner wall portion and an outer wall portion separated from the inner wall portion by a space.

6. The container of claim 5 wherein the means for joining said sections together comprises a pair of spaced apart rods running completely around the inner surface of the outer wall portion of the side wall.

7. The container of claim 6 wherein the means for joining said side wall sections together additionally includes rivets at each of the corners of said side wall, each of said rivets engaging the side wall and one of the rods.

8. The container of claim 1 and further including a channel fixedly attached to said side wall and running completely around the top thereof, said flexible tubing being fitted into said channel.

9. A container for encasing specimens sealed from the ambient atmosphere comprising:

a side wall having four side wall sections forming a rectangle, said wall sections each having an inner wall portion and an outer wall portion separated from the inner wall portion by a space, a pair of spaced apart rod members running completely around the inner surface of the outer wall portion of said side wall, rivet means for joining said four wall sections together at their ends, said rivet means being force fitted into said rod members and with said rod members establishing a firm attachment between said wall sections, a top channel running completely around the top of the inner wall portion of said side wall, flexible tubing forming a gasket mounted in said top channel and running completely therearound, a bottom portion comprising a substantially flat plate member, means for attaching said bottom portion to the bottom of said side wall in sealed air tight relationship therewith, a top portion forming a window comprising a substantially flat transparent plate, and a pair of latch members pivotally mounted on the top of a pair of opposing ones of said side wall sections, said latch members being manually actuable between a first position whereat said latch members drive said top portion against said gasket to form an air tight seal between the top portion and the side wall with said top portion retained to said side wall and a second position whereat said top portion is released from said side wall.

10. The container of claim 9 wherein said top portion forming said window is of an ultraviolet blocking material.

* * * * *